US005137235A

United States Patent [19]

Wentworth et al.

[11] Patent Number: 5,137,235

[45] Date of Patent: Aug. 11, 1992

[54] INVERTED ANGLE DRILL

[75] Inventors: Darel L. Wentworth, Anchorage, Ak.; Martin K. Carty, Tempe, Ariz.

[73] Assignee: U-Haul International, Inc., Phoenix, Ariz.

[21] Appl. No.: 575,143

[22] Filed: Aug. 29, 1990

[51] Int. Cl.[5] ..... A47G 29/00

[52] U.S. Cl. ..... 248/124; 248/130; 248/131; 248/132; 248/133; 254/105; 408/129

[58] Field of Search ..... 248/121, 124, 129, 130, 248/131, 132, 133, 145; 254/105, 124, 129; 269/208; 173/30, 36, 37; 408/129

[56] References Cited

U.S. PATENT DOCUMENTS

| | | | |
|---|---|---|---|
| 959,007 | 5/1910 | Harvey | 173/30 |
| 1,852,736 | 4/1932 | Connell | 173/13 |
| 2,470,694 | 5/1949 | Foo | 248/124 X |
| 2,765,796 | 10/1956 | Guenther | 248/124 X |
| 2,879,677 | 3/1959 | Baublitz | 173/141 |
| 3,417,949 | 12/1968 | Waber | 248/647 |
| 4,234,155 | 11/1980 | Destree | 248/124 X |
| 4,442,905 | 4/1984 | Agoston | 173/36 |
| 4,736,804 | 4/1988 | Geibel | 173/30 |

FOREIGN PATENT DOCUMENTS

| | | | |
|---|---|---|---|
| 2220112 | 1/1973 | Fed. Rep. of Germany . | |
| 2420273 | 6/1975 | Fed. Rep. of Germany . | |
| 212130 | 7/1980 | Fed. Rep. of Germany . | |
| 0276053 | 8/1927 | United Kingdom | 248/124 |
| 548152 | 9/1942 | United Kingdom . | |

*Primary Examiner*—Ramon O. Ramirez

*Attorney, Agent, or Firm*—Spensley Horn Jubas & Lubitz

[57] ABSTRACT

A portable stand supports and positions an inverted power drill relative to an overlying workpiece. The power drill is adjustably positionable both vertically and angularly with respect to the workpiece.

7 Claims, 4 Drawing Sheets

FIG. 2A
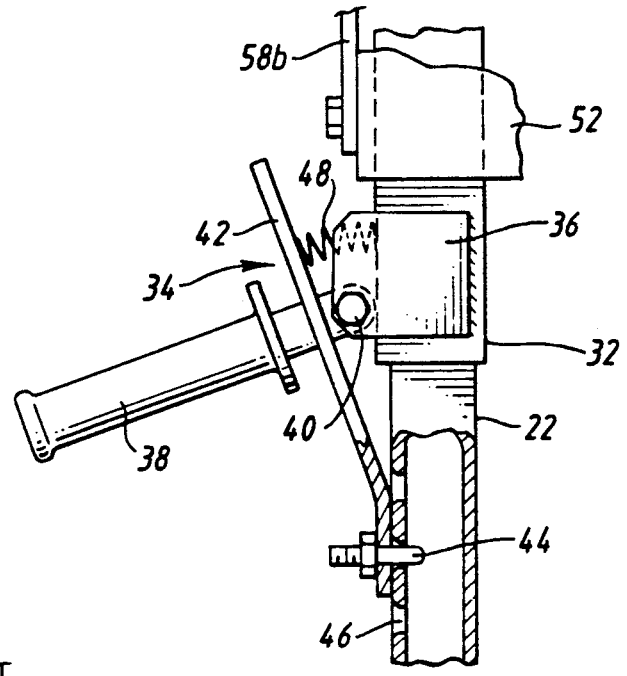
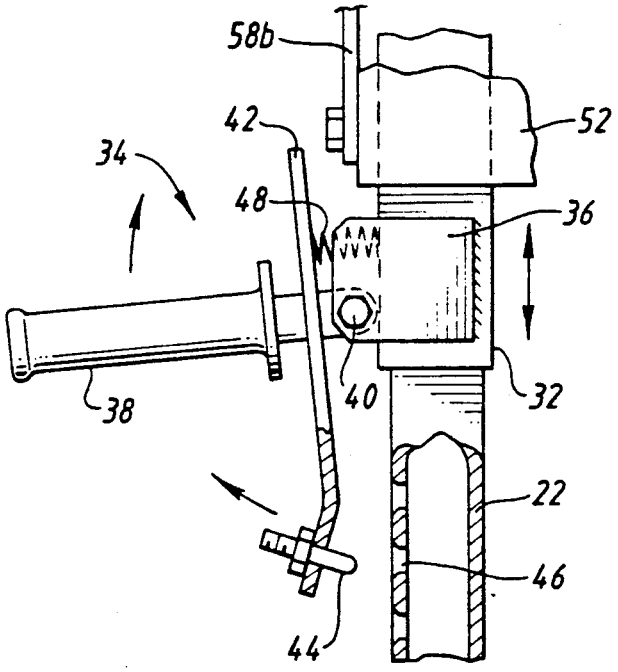
FIG. 2B
FIG. 3
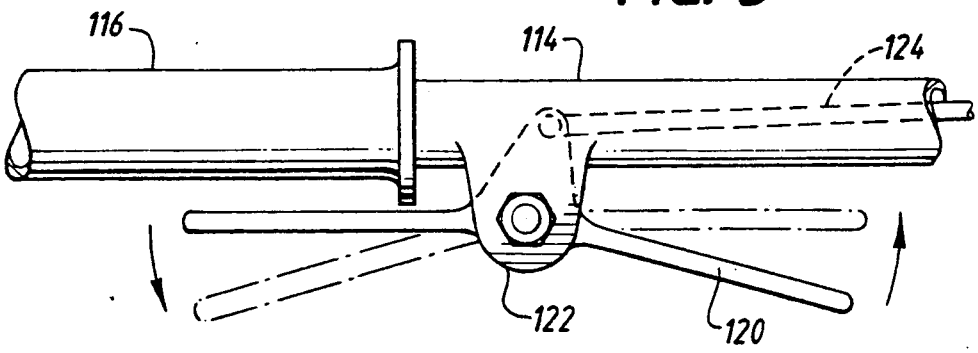

INVERTED ANGLE DRILL

FIELD OF THE INVENTION

The present invention relates generally to portable supports for power drills, and particularly, to an inverted power drill support that is height adjustable, allows drilling operations at various angles, provides a leverage advantage that reduces operator effort, and minimizes risks to the operator using the power drill support.

BACKGROUND OF THE INVENTION

A well known type of power drill apparatus, the drill press, is commonly used to accurately guide a drill bit through a motion range.

Most commonly available drill presses are of the type in which the drill is lowered into contact with the workpiece. Only a limited number of drill presses can perform a drilling operation on an overhead or overlying surface, that is, a surface which is only readily accessible from a position directly underneath.

Prior art inverted drill presses, while facilitating drilling operations on overlying surfaces, are often cumbersome and not readily mobile. Moreover, many of these prior art presses require the operator to be positioned close to the power drill support and thus, beneath the drilling site. Such a requirement increases the risk of injury to the operator from falling metal particles dislodged during the drilling process.

These problems are particularly significant in the context of drilling operations underneath a vehicle. More particularly, the prior art drill presses have not been well suited for use in the installation of trailer hitches or similar devices on automobile frames.

Due in part to the substantial design changes which have occurred in the automobile industry over the past decade, today's vehicles are often unable to accommodate a temporary multi-clamp hitch that would attach directly to the vehicle bumper. Therefore, the installation of a bolt-on trailer hitch, or similar device, on such late model vehicles becomes necessary. The installation of a bolt-on hitch generally requires overhead drilling, and can pose significant problems.

For instance, if a hydraulic lift is not available, the installer must use jacks or ramps for raising an end of the vehicle. In either case, the installer must be positioned beneath the partially elevated vehicle, thereby increasing the hazards associated with the installation operation. Moreover, because the elevated vehicle is at an angle relative to the floor surface, not only must the operator generate enough vertical force so that the drill bit penetrates the vehicle frame, but the power drill must be held at an angle so that the bit is perpendicular to the frame surface. Applying sufficient force at the proper angle can be awkward and poses a drill control problem for the operator.

Moreover, even if the installer has access to a standard overhead vehicle lift, the available prior art overhead drill presses require that the operator be positioned proximate the drill press during drilling. As previously mentioned, such a location increase the danger with which the drilling operation is conducted since the operator is exposed to the expelled metal fragments of the drilled vehicle frame. Furthermore, as most garage floors are sloped for drainage, the drill bit of a standard inverted drill press will not be perpendicular to the vehicle frame unless the angle of the drill press base is adjusted relative to the floor.

SUMMARY OF THE INVENTION

It is an object of the present invention to provide an inverted drill assembly obviating, for practical purposes, the above-mentioned limitations.

In accordance with the broad aspects of the invention, there is provided a portable assembly for supporting and positioning, both vertically and angularly, an inverted power drill relative to a surface of an overlying workpiece. All of the positioning and operating controls of the support assembly are removed from the vicinity of the power drill so as to enhance operator safety.

In accordance with a specific, exemplary embodiment of the invention, the power drill support assembly includes a stable, mobile pedestal positionable along a floor underneath the vicinity of the workpiece. Mounted on the pedestal is an upright standard supporting a power drill carriage for moving the drill toward and away from the workpiece surface. The carriage is pivotally mounted on the standard and the angle of the drill relative to the workpiece is controlled by a tilt lever coupled to the carriage. The carriage includes means for locking the carriage at the selected drill angle.

The carriage further includes a parallel linkage for controlling the motion of the power drill toward and away from the workpiece along a generally linear path. The parallel linkage is actuated by a power drill feed lever actuated by the operator. The power drill feed lever provides a leverage advantage which reduces operator effort requirements.

BRIEF DESCRIPTIONS OF THE DRAWINGS

To facilitate an understanding of the invention, the accompanying drawings illustrate a preferred embodiment. The above and other objects of the invention, as well as the features thereof as summarized above, will become more apparent from the following description when taken in conjunction with the accompanying drawings in which:

FIGS. 2A and 2B are side elevation views, partly in cross section, of a height adjustment latch mechanism forming part of the apparatus of FIG. 1, with the mechanism shown in the latched configuration in FIG. 2A and unlatched in FIG. 2B;

FIG. 3 is a side elevation view of a handle switch mechanism comprising part of the apparatus of FIG. 1;

DETAILED DESCRIPTION OF THE PREFERRED EMBODIMENT

Figure 1:
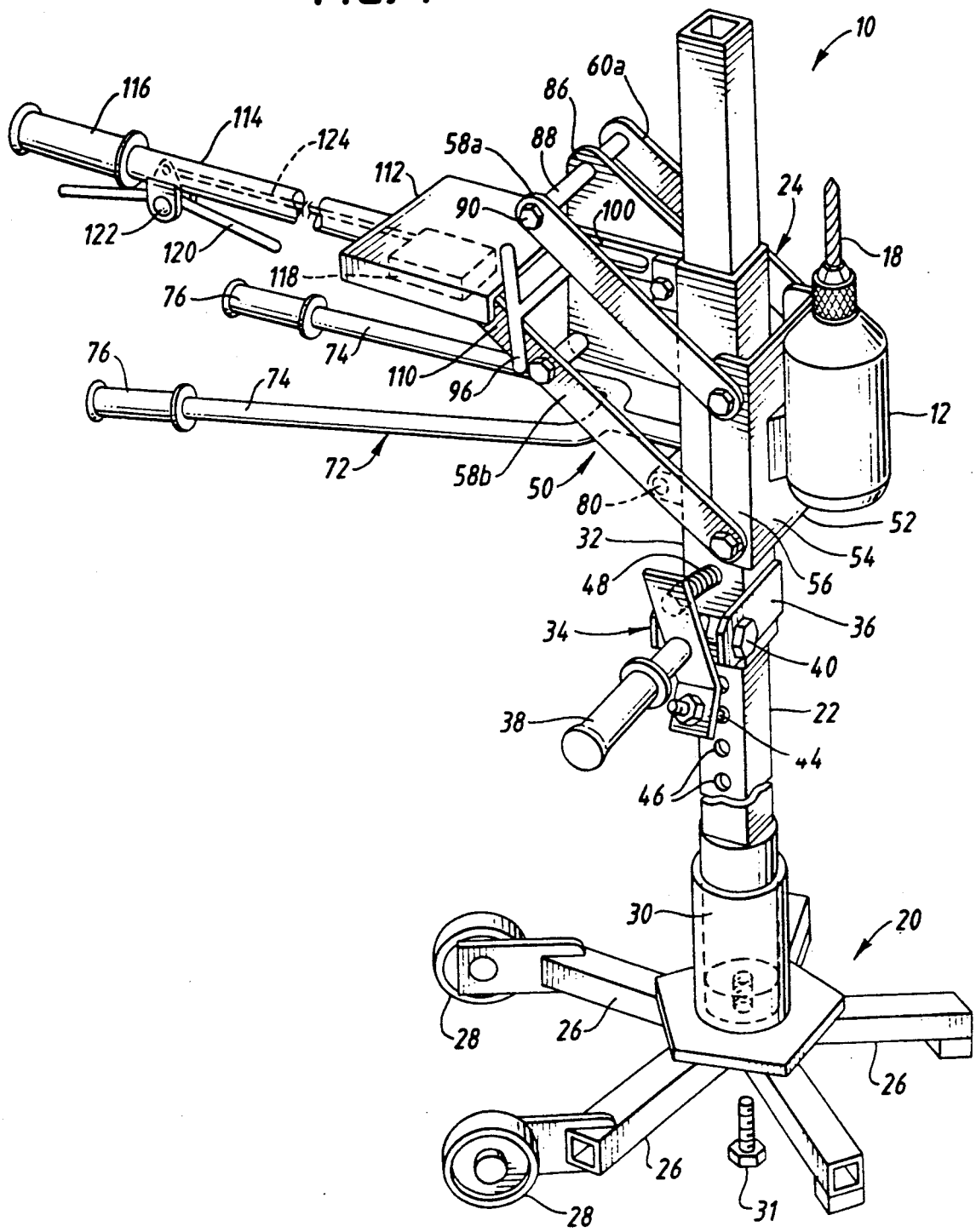
FIG. 1 is a perspective view of an inverted angle drill in accordance with a preferred embodiment of the present invention.

Turning now to the drawings, there is shown a portable assembly 10 for supporting and positioning an inverted power drill 12 relative to an overlying workpiece 14, for example, the frame of an automobile, having a surface 16. The power drill carries a drill bit 18. The assembly 10 includes, generally, a pedestal 20, an upright standard 22 mounted on the pedestal and an adjustable carriage 24 supporting the inverted power drill. The pedestal includes radially-extending feet 26 providing a wide, stable base. Two of the feet 26 have casters or rollers 28 at their outer ends to facilitate moving the portable assembly 10.

Welded to the pedestal 20 is a vertical receptacle 30 for receiving the lower end of the upright standard 22. The standard and the receptacle may be fabricated of tubular steel stock so dimensioned that the standard 22 fits closely within the receptacle 30. The vertical receptacle 30 and the lower portion of standard 22 are round to allow rotational movement of the carriage 24. A threaded fastener 31 inserted through a hole in the pedestal centered under receptacle 30 engages threads (not shown) at the bottom of standard 22 and prevents accidental separation of the standard 22 and the pedestal 20. Removal of threaded fastener 31 allows standards of various heights to be interchangeably used in the support of assembly 10 to accommodate a variety of drilling environments.

The carriage 24 is mounted, in a manner to be described, on a square tube 32 slidably received by, and adjustably positionable along, the standard 22. Such vertical adjustment permits the assembly 10 to be used with vehicles of different frame heights or with vehicles elevated to different heights.

The assembly 10 includes a latch mechanism 34 mounted on the tube 32 for securing the tube 32, and therefore the carriage and power drill, at a selected height along the standard 22. The latch mechanism 34 is carried by a pair of side plates 36 welded to and projecting from the lower end of the tube 32. The mechanism 34 consists of a handle 38, pivotally mounted at 40 on the side plates 36, and a generally vertically oriented, narrow plate 42 attached to the handle 38 adjacent the pivot 40. A latch pin 44 secured to the lower end of the plate 42 is adapted to enter any of a plurality of vertically spaced apertures 46 formed in one of the sides of the standard 22. A compression spring 48, interposed between the upper end of the plate 42 and the confronting face of the tube 32, biases the handle and plate counterclockwise (as seen in FIGS. 2A and 2B), that is, to the latching position in which the pin 44 is received by one of the apertures 46 (FIG. 2A).

To adjust the carriage and power drill height, the operator pulls up on the handle 38, causing it and the plate 42 to pivot in a clockwise fashion about the pivot 40, as shown in FIG. 2B, withdrawing the pin 44 from the aperture permitting the operator to slide the carriage and power drill up or down along the standard. Once a new position is reached, the handle 38 is released causing the pin 44, under the bias of the spring 48, to enter another one of the apertures 46 thereby locking the apparatus in place vertically.

The carriage 24 includes a parallel linkage 50 having a bracket 52 comprising a web portion 54 for supporting the power drill and side flanges 56. The parallel linkage 50 includes a first pair of parallel, identical side links **58*a*, 58*b* disposed along one side of the standard 22 and a second pair of parallel side links 60*a*, 60*b* identical to and parallel to the first pair, adjacent the other side of the standard. One end of each of the link pairs is fastened by pivot pins 62 to a flange 56 of the bracket 52** at spaced apart points.

Figure 4:
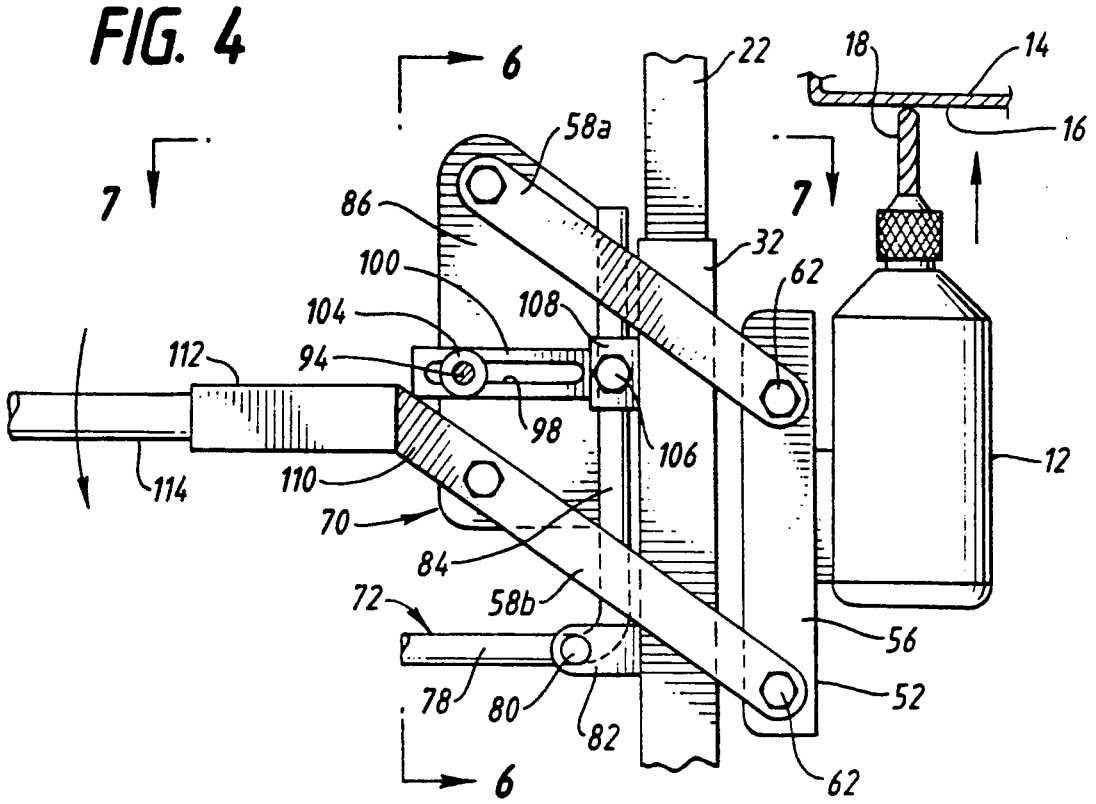
FIGS. 4 and 5 are side elevation views showing details of a power drill support carriage in accordance with the preferred embodiment.
Figure 5:
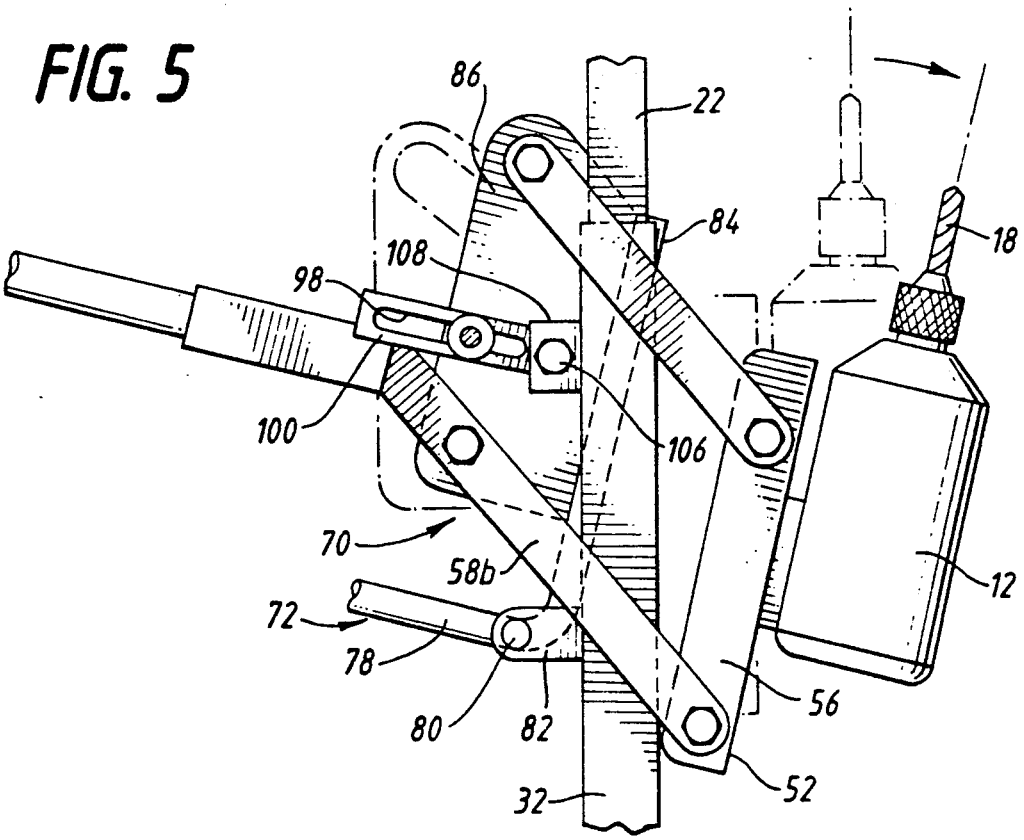
Figure 6:
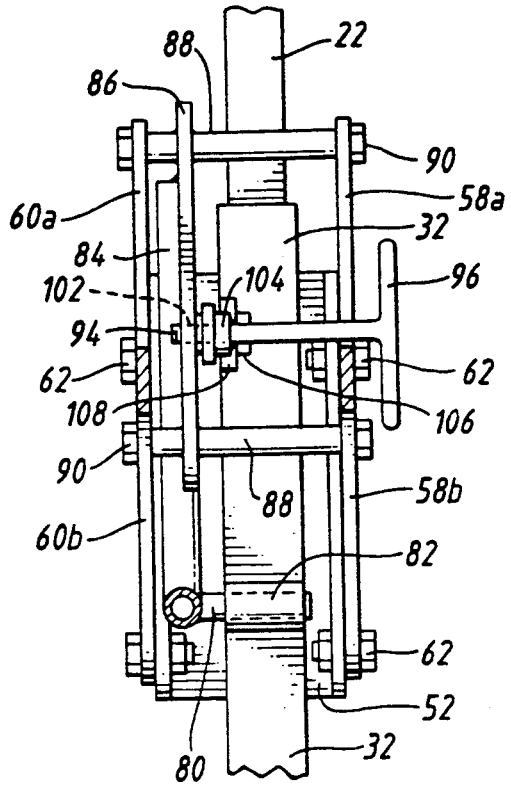
FIG. 6 is an end elevation view, partly in cross section, of the power drill support carriage as seen along the plane 6—6 in FIG. 4.
Figure 7:
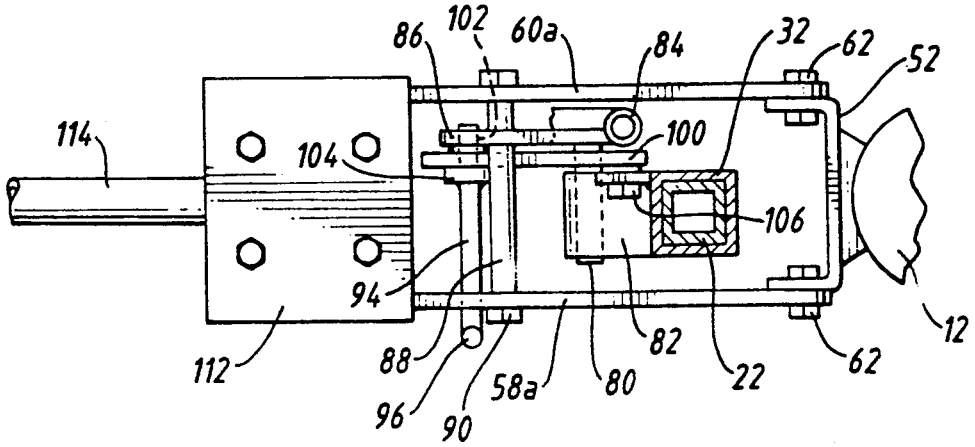
FIG. 7 is a top plan view, partly in section, of the power drill support carriage as seen along the plane 7—7 in FIG. 4.

The carriage 24 also includes a tilt mechanism 70 (FIGS. 4 and 5) for adjusting the angle of the power drill 12 so as to facilitate the orientation of the drill bit 18 perpendicular to the workpiece surface 16. The tilt mechanism includes a tilt control lever 72 having an outer, bifurcated end 74 with grip handles 76 and an inner end 78 mounted on a horizontal pivot shaft 80 rotatable in a sleeve 82 secured to the slidable tube 32. The tilt control lever 72 is thereby movable up and down about a horizontal pivot axis defined by the shaft 80 and sleeve 82.

The inner end of the tilt control lever 72 includes a generally vertical extension 84, perpendicular to the main, bifurcated portion of the lever. A vertical tilt plate 86 is welded along its forward edge to the lever extension 84. It will thus be seen that the plate 86 can be angularly displaced or tilted in its vertical plane about the pivot by moving the tilt control lever 72 up and down. To facilitate unimpeded tilting of the plate, the lever 72 and plate 86 are laterally offset so that the plate clears the standard 22 as it is moved to different angular positions.

A pair of transversely-extending sleeves 88 are welded to the tilt plate 86 adjacent the rear edge of the plate. The sleeves 88 are vertically separated by a distance equal to that separating the link pivot pins 62 on each flange of the power drill support bracket 52.

The other ends of the link pairs 58, 60 are fastened to the tilt plate by pivot pins 90 rotatably received by the sleeves 88 thereby defining a four bar parallel linkage.

The carriage 24 is locked by the operator at a selected angular position by means of a threaded rod 94 terminating in a T-handle 96. The end of the threaded rod passes through a slot 98 in a hinged lock plate 100 and is received by a threaded hole 102 in the tilt plate. A collar 104 welded to the threaded rod clamps the tilt plate 86 against the lock plate 100 upon tightening of the threaded rod by means of the T-handle 96. The lock plate is hingedly attached to the slidable tube 32 by means of a hinge pin 106 on a projecting tab 108 welded to the slidable tube.

The ends of the lower links **58*b*, 60*b* attached to the tilt plate 86 have extensions 110 which are joined by a bracket 112 to a drill feed lever 114 having a hand grip 116 at its outer extremity. Accordingly, up and down movement of the feed lever 114 causes the power drill 12 to move up and down in parallel fashion through the action of the parallel linkage 50 pivoting on the tilt plate. Although the parallel linkage causes the power drill to describe an arc as it is moved up and down by the feed lever, it will be appreciated that for the small displacements involved in drilling through an automobile frame member, that motion is linear for all practical purposes. The length of the feed lever 114 is considerably greater than that of the portion of the side links 58*a*, 58*b* between the pivot pins 62 and 90**. Accordingly, a substantial mechanical advantage is provided so as to reduce operator effort.

The feed lever 114 includes, under bracket 112, an air valve 118 for controlling the energization and direction of rotation of the power drill 12 via conduits and hoses (not shown) in a manner well known in the art. Actuation of the valve 118 is controlled by a fore-and-aft extending rod 120 pivotally attached to the feed lever by means of a pivot bracket 122, and joined to the air valve through connecting rod 124.

It will be appreciated that the invention described provides a versatile, portable inverted power drill support in which the vertical position as well as the angle of the drill may be easily adjusted so as to permit rapid installation of trailer hitches and the like to automobile frames. All operator manipulated elements, including the levers 72 and 114 and the tilt lock T-handle 96 are well removed from the vicinity of the power drill thereby minimizing risks of injury while using the equipment.

While it will be obvious to those skilled in the art that the invention is susceptible of various modifications and alternative constructions, one specific, preferred embodiment thereof has been shown in the drawings and described in detail. It should be understood, however, that there is no intention to limit the invention to the specific form illustrated and described, but on the contrary, the intention is to cover all modifications, alternative constructions and equivalents falling within the spirit and scope of the invention as defined by the appended claims. For example, it will be obvious that the drill 12 may be either pneumatically or electrically powered.

We claim as our invention:

1. A portable assembly for supporting an inverted power drill relative to a surface of an overlying workpiece, the assembly comprising:

a pedestal positionable along a support surface such as a floor;

an upright standard mounted on the pedestal;

a carriage for supporting the power drill and for moving the power drill toward and away from the workpiece surface, the carriage being pivotally mounted on the standard;

means for pivoting the carriage to select the angle of the power drill relative to the workpiece surface; and means for adjustably locking the carriage at the selected angle of the power drill.

2. A portable assembly, as set forth in claim 1, in which:

the carriage includes a tilt plate pivotally mounting the carriage on the standard;

and which includes:

a tilt control lever extending from the tilt plate for controlling the angle of the power drill.

3. A portable assembly, as set forth in claim 2, in which:

the carriage includes a parallel linkage for carrying the power drill, the linkage being mounted on the tilt plate;

and which includes:

a power drill feed lever attached to the linkage for controlling the movement of the power drill toward and away from the workpiece surface.

4. A portable assembly, as defined in claim 3, in which:

the power drill feed lever includes an end portion distal the parallel linkage; and a power drill control mechanism is mounted on said end portion of the feed lever.

5. A portable assembly, as defined in claim 4, in which:

the power drill feed lever provides a substantial mechanical advantage so as to reduce operator effort.

6. A portable assembly, as defined in claim 1, which includes:

means for selectively positioning the carriage vertically along the upright standard.

7. A portable assembly, as defined in claim 1, in which:

the upright standard is rotatably mounted on the pedestal.

* * * * *